US012606994B2

(12) United States Patent
Janarthanan et al.

(10) Patent No.: US 12,606,994 B2
(45) Date of Patent: Apr. 21, 2026

(54) DIAGNOSTIC SYSTEM FOR MONITORING A HYDRAULIC SYSTEM

(71) Applicant: Cummins Inc., Columbus, IN (US)

(72) Inventors: Rahul Janarthanan, Columbus, IN (US); Micah Uemura, Columbus, IN (US); John Ringstad, Columbus, IN (US); John P. O'Brien, Columbus, IN (US)

(73) Assignee: Cummins Inc., Columbus, IN (US)

( * ) Notice: Subject to any disclaimer, the term of this patent is extended or adjusted under 35 U.S.C. 154(b) by 86 days.

(21) Appl. No.: 18/439,902

(22) Filed: Feb. 13, 2024

(65) Prior Publication Data

US 2024/0271394 A1 Aug. 15, 2024

Related U.S. Application Data

(60) Provisional application No. 63/445,393, filed on Feb. 14, 2023.

(51) Int. Cl.
*E02F 9/26* (2006.01)
*E02F 9/20* (2006.01)
*E02F 9/22* (2006.01)

(52) U.S. Cl.
CPC ..... *E02F 9/267* (2013.01); *E02F 9/207* (2013.01); *E02F 9/2278* (2013.01)

(58) Field of Classification Search
CPC ..... E02F 9/267; E02F 9/207; E02F 9/2278; E02F 9/226; B60W 50/0205; B60W 2050/021; B60W 2050/022; B60W 50/04; B60W 2300/15; B60W 2300/17;
(Continued)

(56) References Cited

U.S. PATENT DOCUMENTS 9,206,667 B2 12/2015 Khvoshchev et al.
9,890,799 B2 * 2/2018 Gomm ..... F15B 20/008
(Continued)

FOREIGN PATENT DOCUMENTS

CN 203465093 U 3/2014
CN 104569817 B 4/2015
DE 19847949 A1 4/2000

OTHER PUBLICATIONS

Das, Jayanta et al. "Modern Advancement of Hydraulic Motor: A Review" from Applied Mechanics and Materials, vols. 592-594 (Jul. 2014) pp. 2179-2183.
(Continued)

*Primary Examiner* — Bao Long T Nguyen
(74) *Attorney, Agent, or Firm* — Faegre Drinker Biddle & Reath LLP

(57) ABSTRACT

A diagnostic system for determining a performance status of a hydraulic system of an electric work machine, the hydraulic system having a first hydraulic pump driven by an electric motor for pumping hydraulic fluid within the hydraulic system, the system comprising: a hydraulic diagnostic module configured to receive a first operating variable of the electric motor, the hydraulic diagnostic module further being configured to compare the first operating variable of the electric motor with a predetermined operational behavior and to derive a performance status of the hydraulic system based on the comparison.

18 Claims, 6 Drawing Sheets

(58) Field of Classification Search
CPC ..... F15B 2211/665; F15B 19/005; F15B 2211/20515; F15B 21/08; F15B 2201/50; F15B 20/00
See application file for complete search history.

(56) References Cited

U.S. PATENT DOCUMENTS

| | | | | |
|---|---|---|---|---|
| 10,837,466 | B2 | 11/2020 | Bohatsch et al. | |
| 2022/0333349 | A1* | 10/2022 | Nakamura | F15B 20/004 |

OTHER PUBLICATIONS

Daniel, Ryszard et al. "Hydraulic Motor" Handbook of Natural Gas Transmission and Processing (Fourth Edition), 2019. <https://www.sciencedirect.com/topics/engineering/hydraulic-motor>.

* cited by examiner

DIAGNOSTIC SYSTEM FOR MONITORING A HYDRAULIC SYSTEM

CROSS-REFERENCE TO RELATED PATENT APPLICATIONS

The present application claims priority to U.S. Provisional Patent Application No. 63/445,393, filed Feb. 14, 2023, which is incorporated herein by reference in its entirety.

FIELD OF THE DISCLOSURE

The present disclosure relates to a diagnostic system for determining a performance status of a hydraulic system driven by an electric motor. The present disclosure also relates to an electric work machine incorporating such a diagnostic system. The present disclosure further relates to a method of determining a performance status of a hydraulic system driven by an electric motor.

BACKGROUND

Construction machines such as hydraulic excavators which are used in excavating and demolition operations and which employ a diesel engine to drive a hydraulic pump or set of hydraulic pumps have been in use for many years. In such machines hydraulic fluid is pumped to various hydraulic actuators in order to operate work tools, such as a boom and bucket.

Electric hydraulic construction machines have been replacing previous models powered by diesel engines in order to reduce emissions. Such electric hydraulic construction/off-highway equipment and machines include, for example, excavators, telehandlers, forklifts, etc., with electrohydraulic powertrain architecture. Such machines can be collectively referred to as electrohydraulic work machines.

Various problems can arise in hydraulic systems which affect the performance of the system and can damage parts of the systems. Such problems can include particulate contamination of the hydraulic fluid, air in the hydraulic fluid, clogged filters, leaks in the hydraulic circuit, misalignment of parts such as couplings, damaged or worn parts, etc. It would be desirable to be able to provide a system for identifying and predicting faults and servicing needs of a hydraulic system.

SUMMARY

According to one aspect of the present disclosure there is provided a diagnostic system for determining a performance status of a hydraulic system of an electric work machine, the hydraulic system having a first hydraulic pump driven by an electric motor for pumping hydraulic fluid within the hydraulic system, the system comprising:

- a hydraulic diagnostic module configured to receive a first operating parameter or variable of the electric motor,
- the hydraulic diagnostic module further being configured to compare the first operating parameter or variable of the electric motor with a predetermined operational behavior of the electric motor and to derive a performance status of the hydraulic system based on the comparison.

The invention provides a diagnostic tool to identify failures or maintenance requirements in the hydraulic system by monitoring the electric motor performance. This allows issues to be identified early on. The hydraulic system may comprise a hydraulic pump, hydraulic fluid tank, hydraulic fluid cooler, control valves and hydraulic actuators. The first operating variable of the electric motor in some examples may be compared with a predetermined operational behavior which may comprise a predetermined threshold value for said operating variables. The hydraulic system in some examples may have at least one work device that is hydraulically powered by the hydraulic system. The hydraulic diagnostic module may include at least one processor. The hydraulic diagnostic module may be incorporated into other control units or processors of the electric work machine, such as a Vehicle Control Unit (VCU) or System Control Module (SCM).

In some examples the hydraulic diagnostic module is further configured to receive a signal corresponding to a first sensed temperature value sensed by a temperature sensor configured to sense a temperature of the hydraulic fluid, the hydraulic diagnostic module being configured to compare the first operating variable of the electric motor with a predetermined operational behavior, and wherein the predetermined operational behavior used in the comparison may differ depending on said sensed temperature value.

The viscosity of the hydraulic fluid may vary depending on the temperature of the hydraulic fluid, therefore the first operating variable of the electric motor is compared with a predetermined operational behavior for the given temperature value that has been sensed.

In some examples, the hydraulic diagnostic module is configured to determine the performance status of the hydraulic system without receiving any input from sensors which sense characteristics of the hydraulic system itself, apart from optionally receiving sensed temperature values of the hydraulic fluid.

The diagnostic system does not include any sensors for sensing characteristics of the hydraulic system, except in certain embodiments a temperature sensor to sense the temperature of the hydraulic fluid.

In some examples, the first operating variable of the electric motor comprises a variable selected from the following: motor speed, motor torque, and power drawn by the hydraulic pump.

In some examples, the performance status of the hydraulic system that may be derived from the comparison comprises a fault condition or a maintenance requirement.

A fault condition could be an indication of any sort of abnormality detected in the hydraulic system which may need inspection or further monitoring. A maintenance requirement may be any service action that needs to take place to keep the hydraulic system running in good order.

In some examples, the fault condition of the hydraulic system that may be derived from the comparison comprises one or more of the following:

- a hydraulic pump jam;
- a blockage in the hydraulic system;
- a trapped air condition indicating air entrapped within at least part of the hydraulic system;
- a leak condition indicating leakage within at least part of the hydraulic system;
- a misalignment condition indicating misalignment of any parts within the hydraulic system; and
- incorrect hydraulic fluid present in the hydraulic system.

In some examples, the maintenance requirement of the hydraulic system that may be derived from the comparison comprises one or more of the following:

- an indication that the hydraulic system requires a fluid change; or
- an indication that the hydraulic system requires a filter change.

The maintenance requirement of the hydraulic system that may be derived from the comparison may comprise an indication that any serviceable item requires replacing. A maintenance requirement of the hydraulic system that may be derived from the comparison may also be an indication that a non-serviceable component requires repair or replacement.

In some examples, the maintenance requirement comprises a predicted maintenance requirement derived from the comparison of the first operating variable of the electric motor with a predetermined operational behavior.

A predicted maintenance requirement may be a prediction that a maintenance requirement will be due at a certain point in the future.

In some examples, the electric motor has a first idling speed, said first operating variable being motor speed and the predetermined operational behavior being the electric motor spinning up to reach its first idling speed within a predetermined time, wherein the hydraulic diagnostic module derives a fault condition as the performance status of the hydraulic system if the electric motor fails to reach its first idling speed within said predetermined time.

The first idling speed of the electric motor is a speed at which the rotor of the electric motor rotates when the hydraulic system is not performing work. The first idling speed may be a first preset idling speed set by an operator. The fault condition may be a misalignment condition indicating misalignment of any parts within the hydraulic system, or it may be a hydraulic pump jam condition indicating a jam in the hydraulic system, such as due to improper lubrication, or a blockage condition indicating a blockage in the hydraulic system, such as a blockage in a suction hose. In certain embodiments, the operational behavior is spinning up of the electric motor from a non-rotating condition to reach its first idling speed. The hydraulic diagnostic module suitably monitors the motor as it is spinning up to the first idling speed.

In some examples, the electric motor has a first idling speed, the first operating variable being power drawn by the hydraulic pump during spinning up of the electric motor to reach its first idling speed and the predetermined operational behavior being a predetermined power drawing activity of the electric motor during spinning up of the electric motor to reach its first idling speed, wherein the hydraulic diagnostic module derives a fault condition as the performance status of the hydraulic system if power drawn by the hydraulic pump deviates from the predetermined power drawing activity.

In some examples, the predetermined operational behavior comprises the power drawn by the hydraulic pump during spinning up of the electric motor to reach its first idling speed being within a predetermined range, the hydraulic diagnostic module deriving a fault condition as the performance status of the hydraulic system if power drawn by the hydraulic pump is outside of the predetermined range.

If it is detected that the power drawn by the hydraulic pump as it spins up to reach its first idling speed is not stable, the fault condition derived could be a trapped air condition indicating air entrapped within at least part of the hydraulic system. The system may be configured to output an alert if any fault condition is detected. The performance status derived from detecting a trapped air condition may be an advisory condition which does not trigger a fault status to the operator upon initial detection. The hydraulic diagnostic module may be configured such that an output alert is only triggered if a fault condition of a trapped air condition is detected more than a predetermined number of times. For example, if the trapped air condition is derived by more than a threshold number of times in succession, the system may output an alert indicating an air trapped condition.

In some examples, the electric motor has a first idling speed, the first operating variable comprising motor torque required during spinning up of the electric motor to reach its first idling speed and the predetermined operational behavior comprising the electric motor spinning up to reach its first idling speed at a threshold motor torque, wherein the hydraulic diagnostic module derives a leak condition indicating leakage within at least part of the hydraulic system as the performance status of the hydraulic system if the motor torque required during spinning up is less than the predetermined threshold motor torque.

The motor torque value in some examples may be compared to the threshold value at the corresponding hydraulic fluid temperature, so as to take account of the impact of differing fluid viscosity depending on the fluid temperature.

In some examples, the electric motor has a first idling speed, the first operating variable comprising motor torque required during spinning up of the electric motor to reach its first idling speed and the predetermined operational behavior comprising the electric motor spinning up to reach its first idling speed at a threshold motor torque, wherein the hydraulic diagnostic module derives a hydraulic pump jam as the performance status of the hydraulic system if the motor torque is more than the predetermined threshold motor torque.

The motor torque value in some examples may be compared to the threshold value at the corresponding hydraulic fluid temperature, so as to take account of the impact of differing fluid viscosity depending on the fluid temperature.

In some examples, the first operating variable comprises torque of the electric motor and the hydraulic diagnostic module is further configured to record the motor torque and sensed temperature value of the hydraulic fluid such that motor torque and sensed temperature value at a plurality of instances over time can be recorded as recorded system data, said predetermined operational behavior being said recorded system data, the hydraulic diagnostic module being configured to derive a maintenance requirement status if a change in motor performance or an acceleration in change in motor performance is derived by comparing torque with the recorded system data.

By means of comparing the motor torque with recorded system data relating to recorded motor torque at previous instances, the system can detect changes in performance of the hydraulic system and identify whether any serviceable items need replacing, such as hydraulic filter or hydraulic fluid. The motor torque and sensed temperature value may be recorded as the electric motor is spinning up to its first idling speed. Alternatively, the motor torque and sensed temperature may be recorded when the electric motor is operating at its set first idling speed. The hydraulic diagnostic module in some examples may have a memory for recording inputs to the hydraulic diagnostic module. The recorded system data may store motor torque and sensed temperature values over the lifetime of the electrohydraulic system so that an instant torque value can be compared against lifetime values at the corresponding hydraulic fluid temperature to detect health of non-serviceable items such as the electric motor, hydraulic pump, hydraulic valves, and hydraulic manifold.

In some examples, the first operating variable comprises motor torque and the hydraulic diagnostic module is further configured to record the motor torque and sensed temperature value of the hydraulic fluid at a plurality of instances over time as recorded system data, said predetermined operational behavior being a degradation model comprising data indicative of expected motor behavior, the hydraulic diagnostic module being configured to derive a maintenance requirement status based on comparison of the recorded system data with the degradation model. By comparing electric motor behavior with the degradation model, acceleration of degradation of the hydraulic system can be detected.

The degradation model may comprise predicted data corresponding to a plurality of different service intervals for the hydraulic system, the hydraulic diagnostic module being configured to store one or more parameters regarding servicing events carried out on the hydraulic system such that the operating variables of the electric motor can be compared with values within the degradation model for the corresponding service interval. The degradation model may also comprise data indicative of expected motor behavior over the lifetime of non-serviceable items associated with the system so that health of non-serviceable items such as the electric motor, hydraulic pump, hydraulic valves, and hydraulic manifold can be monitored. The data in the degradation model can be updated based on data recorded from other electrohydraulic systems of the same kind, said data being updated telematically.

In some examples, the system further comprises an output device for alerting an operator to a derived performance status.

In some embodiments the output device is a display which can be used to display information regarding the performance status. However, the output device may be an audio alert device or a device for transmitting data regarding the performance status to another device.

In some examples, the hydraulic system has a key-on mode wherein the electric motor is spinning up to reach a first idling speed, the diagnostic system being configured to determine the performance status of the hydraulic system during the key-on mode.

In some examples, the hydraulic system has a diagnostic mode wherein the diagnostic system is configured to determine the performance status of the hydraulic system if the diagnostic system is converted to diagnostic mode.

The diagnostic system may be configured such that if the electric motor is not performing any work, an operator can set the diagnostic system to said diagnostic mode, which triggers the system to run the hydraulic diagnostic module to determine a performance status of a hydraulic system. The system may be configured such that it automatically enters the diagnostic mode if it is detected that the electric motor is not performing any work, which triggers the diagnostic system to operate the hydraulic diagnostic module to determine a performance status of a hydraulic system.

According to one aspect of the present disclosure there is provided an electric work machine having at least one work device that is hydraulically powered by a hydraulic system having a first hydraulic pump driven by an electric motor for pumping hydraulic fluid within the hydraulic system, the electric work machine comprising a diagnostic system for determining a performance status of the hydraulic system the diagnostic system comprising:

a hydraulic diagnostic module configured to receive a first operating variable of the electric motor, the hydraulic diagnostic module further being configured to compare the first operating variable of the electric motor with a predetermined operational behavior and to derive a performance status of the hydraulic system based on the comparison.

The hydraulic diagnostic module of the electric work machine may be configured according to any aspect of the disclosure as set out above.

According to one aspect of the present disclosure there is provided a method for determining a performance status of a hydraulic system of an electric work machine, the hydraulic system having a first hydraulic pump, driven by an electric motor, for pumping hydraulic fluid within the hydraulic system, the method comprising (a) comparing a first operating variable of the electric motor with a predetermined operational behavior of the electric motor; and (b) deriving a performance status of the hydraulic system based on the comparison.

The method may determine a performance status of a hydraulic system in any of the ways as set out above in relation to the diagnostic system as set out above.

BRIEF DESCRIPTION OF THE DRAWINGS

Features of the present disclosure will now be described, purely by way of example, with reference to the accompanying drawings, in which.

DETAILED DESCRIPTION OF EMBODIMENTS OF THE DISCLOSURE

The present embodiments represent currently the best ways known to the applicant of putting the invention into practice. But they are not the only ways in which this can be achieved. They are illustrated, and they will now be described, by way of example only.

Figure 1:
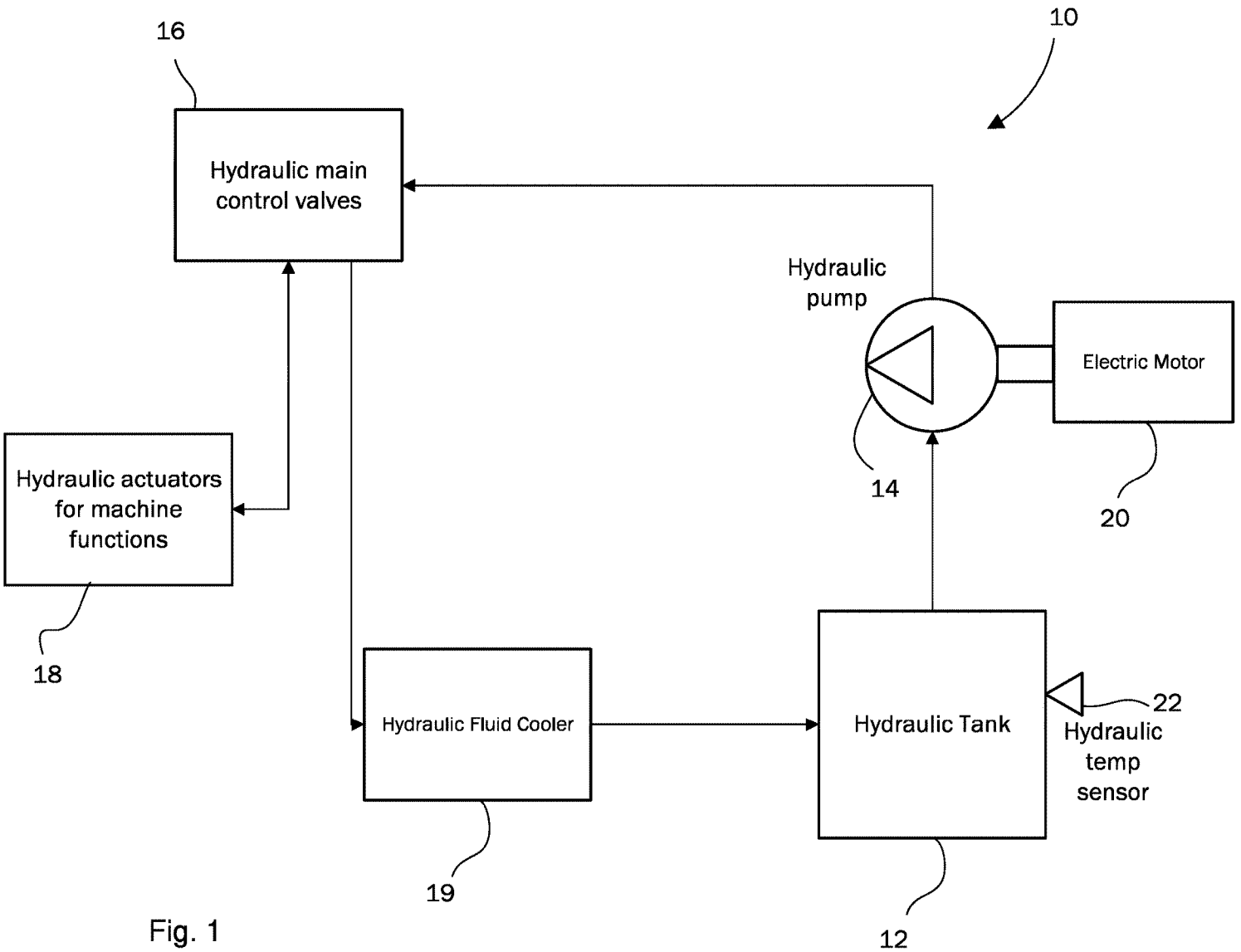
Fig. 1 (PRIOR ART)
FIG. 1 is a schematic diagram showing components of a prior art hydraulic system.

Referring now to the drawings, wherein like reference numerals refer to like features throughout several figures, FIG. 1 is a schematic diagram showing certain components of a prior art electrohydraulic system 10 for an electric hydraulic work machine such as an excavator or other construction machine. The system hydraulically powers a work device, such as a boom and arm assembly with bucket. The hydraulic system comprises a fluid circuit including a hydraulic tank 12 for storing hydraulic fluid such as hydraulic oil and a hydraulic pump 14 for pumping hydraulic fluid for supply to hydraulic actuators 18 for controlling the machine functions.

The hydraulic system 10 further includes a plurality of primary control valves 16 that control the flow of hydraulic fluid supplied from the hydraulic pump 14 to the plurality of hydraulic actuators 18. The hydraulic system 10 also includes a heat exchanger comprising a hydraulic fluid cooler 19 for exchanging heat between hydraulic fluid of the hydraulic system and the air. An electric motor 20 drives the hydraulic pump 14 so that the hydraulic system 10 can power the actuators 18 for controlling the machine functions. Some electrohydraulic systems, such as that of FIG. 1, have a first temperature sensor 22 for sensing the temperature of the hydraulic fluid.

Figure 2:
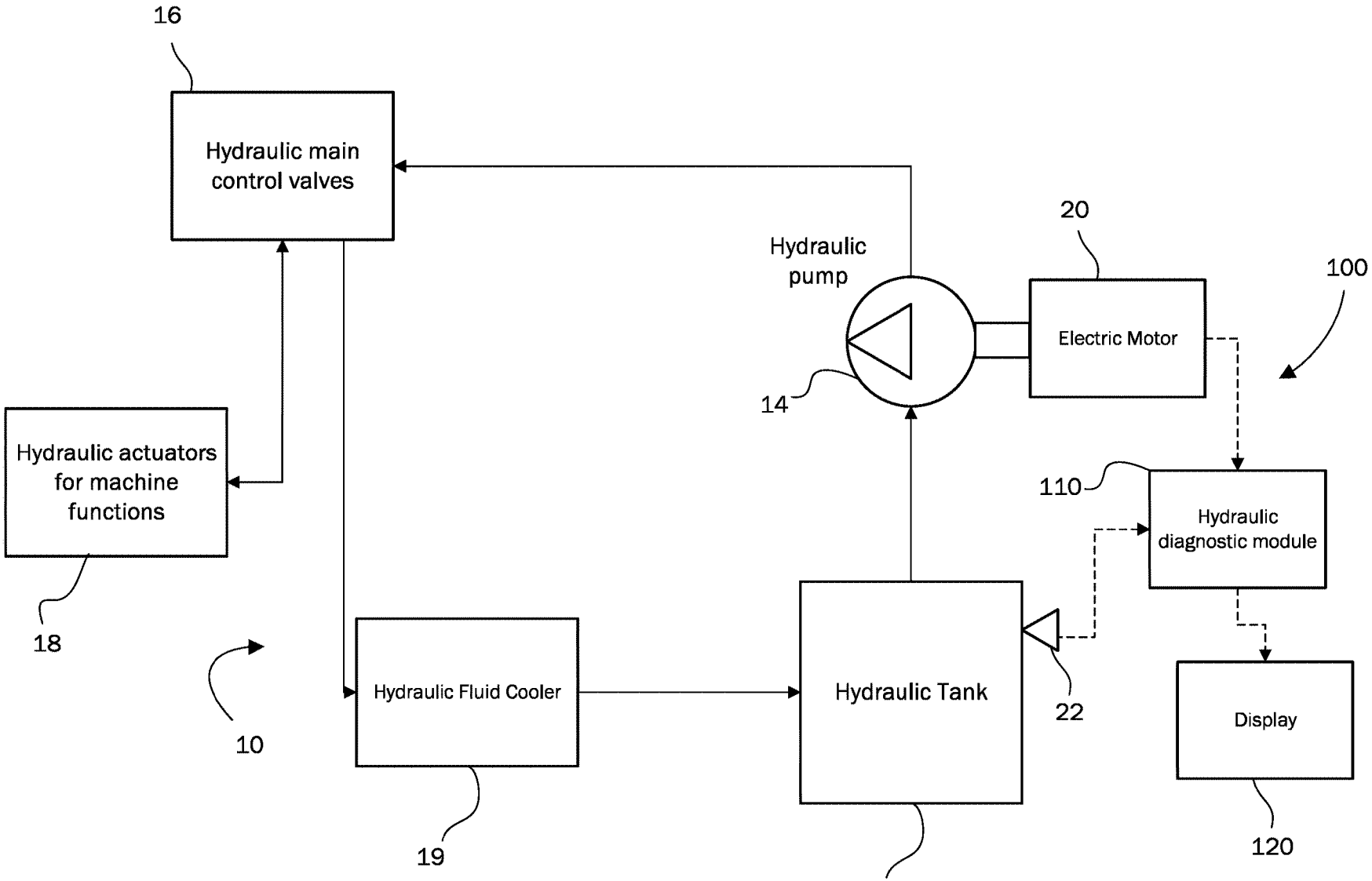
FIG. 2 is a schematic diagram showing the hydraulic system of FIG. 1 with a diagnostic system of the present invention.

Referring to FIG. 2, a schematic diagram showing components of a diagnostic system 100 for use with a hydraulic system 10 like that of FIG. 1 is shown. The diagnostic system 100 determines a performance status of a hydraulic system 10 by monitoring the performance of the electric motor 20. The diagnostic system 100 comprises a hydraulic diagnostic module 110 configured to receive at least a first operating parameter of the electric motor and to compare that with a predetermined operational behavior so as to derive a performance status of the hydraulic system. The diagnostic system 100 is therefore able to diagnose failures or maintenance requirements in the hydraulic system by monitoring the motor performance. This allows problems or servicing needs of the hydraulic system to be identified early. The diagnostic system also allows monitoring of the hydraulic system without additional sensors beyond what is present in a typical electrohydraulic system 10. The diagnostic system 100 may also include a display 120 so that the diagnostic system can output status updates/alerts to an operator. Other output devices may of course be employed instead of a display 120.

Figure 3:
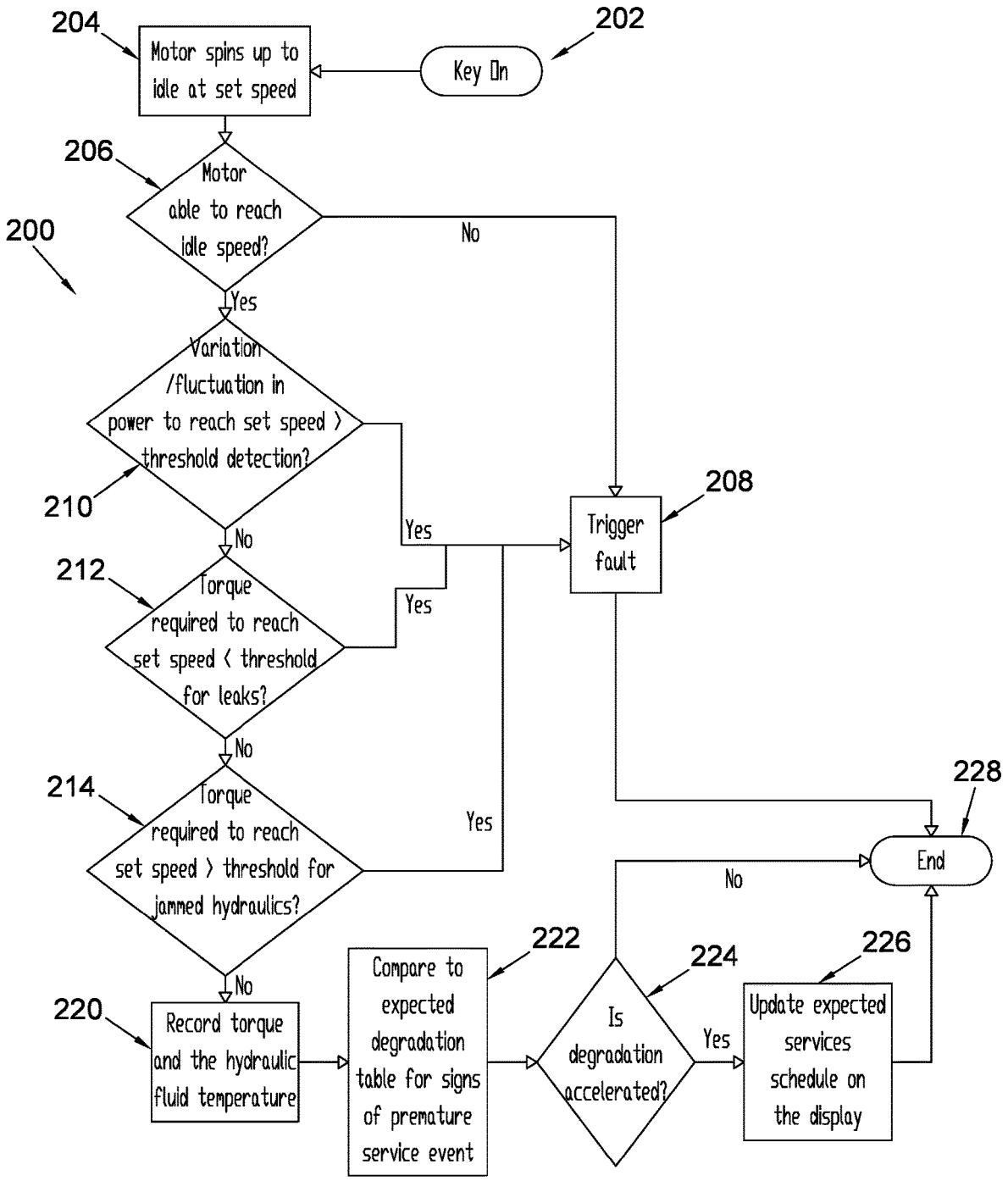
FIG. 3 is a flow chart of an illustrative method performed by the hydraulic diagnostic module.

Referring to FIG. 3, the hydraulic diagnostic module 110 includes an algorithm, instructions, software, or other program configured to perform a diagnostic process 200 to identify a performance status of the hydraulic system. The algorithm for a typical diagnostic process performed by the hydraulic diagnostic module 110 will now be described.

In the embodiment of FIG. 3, the diagnostic process 200 is run by the hydraulic diagnostic module 110 when the electric motor 20 is switched on (i.e. at 'key-on', step 202). After key-on, at step 204, the rotor of the electric motor 20 spins up to idle at a first idling speed. The first idling speed may be a preset idling speed set by the manufacturer or selected by an operator, e.g. from predefined options available.

The hydraulic diagnostic module 110 receives inputs from the electric motor 20 relating to performance of the electric motor. In certain steps the hydraulic diagnostic module 110 receives the motor speed as an input. In other steps, as will be described, the hydraulic diagnostic module 110 receives the motor torque as an input. The hydraulic diagnostic module 110 may furthermore receive the power drawn by the hydraulic pump as an input, which can be inferred from the product of the motor speed and motor torque. The motor speed and motor torque can be inferred from feedback from the motor itself (taking account of the motor voltage and current). Alternatively, the electric motor may include motor sensors to sense the motor speed and/or torque and to output signals relating to the speed and/or torque to the hydraulic diagnostic module 110.

In step 206 the hydraulic diagnostic module 110 receives the electric motor speed as an input and compares it with the preset idling speed of the motor. The hydraulic diagnostic module 110 is configured such that if the motor is unable to reach the preset idling speed of the motor within a predetermined time, the module derives a fault condition (e.g., step 208) as its performance status of the hydraulic system. The motor being unable to reach its preset idling speed may be indicative of a major fault within the hydraulic system, such as a misalignment condition caused by misalignment of parts within the hydraulic system.

The hydraulic diagnostic module 110 may be configured to output an alert if a fault condition is detected or if certain fault conditions are detected, and the alert may indicate the type of fault condition detected. For example, the hydraulic diagnostic module 110 may transmit an alert signal to an output device such as display 120 or an audio alert device. Therefore, if a fault condition (step 208) is derived after any of the diagnostic steps in the process of FIG. 3, an operator can be alerted to the fault. Once a fault condition 208 has been derived, the diagnostic process 200 may end (step 228).

If the motor reaches its preset idling speed, the hydraulic diagnostic module 110 continues to perform further analyses on the motor performance to diagnostically assess the health of the hydraulic system. At step 210 the hydraulic diagnostic module 110 receives the power drawn over time by the hydraulic pump as the motor spins up to its preset idling speed, as an input and compares it with an expected power draw range. If the power drawn by the pump is outside a predetermined range, the module derives a fault condition 208 as its performance status of the hydraulic system. Abnormal variation or fluctuation in the power to reach the preset idling speed is indicative of a trapped air condition wherein there is air trapped within at least part of the hydraulic system. Air trapped in the system can cause cavitation (formation of bubbles in the hydraulic fluid), which can decrease the efficiency of the hydraulic system and cause fatigue and failure in components of the hydraulic system. Therefore, it is important to identify such a problem early so that steps to fix the problem can be taken, such as bleeding air from the system.

Hydraulic fluid will typically contain a small amount of air suspended or dissolved in the fluid. However, it is important to detect whether there is excessive air in the system that is not dissipating naturally, as excessive air can cause damage to the hydraulic system components and lead to poor operation of the work tools that are driven by the hydraulic system. The hydraulic diagnostic module 110 can be configured so that a fault condition 208 and/or alert is only triggered if a trapped air condition is identified more than a predetermined number of times. In this way, if the diagnostic process identifies trapped air in the system repeatedly, each time the hydraulic diagnostic module runs the diagnostic process, a fault condition is triggered so that an operator can troubleshoot the problem.

Another diagnostic process that the hydraulic diagnostic module 110 can perform if the electric motor reaches its first preset idling speed is at step 212 of FIG. 3. At step 212 the hydraulic diagnostic module 110 receives as an input the motor torque required for the electric motor to reach its first preset idling speed and compares it with an expected torque value, namely a predetermined leak torque value. If the torque required to reach the motor's first preset idling speed is below said predetermined leak torque value, then the hydraulic diagnostic module derives a fault condition 208 as its performance status of the hydraulic system. The torque required to reach the electric motor's first preset idling speed being below a predetermined leak torque value is indicative of a leak condition in the hydraulic system, i.e. that there is leakage within at least part of the hydraulic system. Once a fault condition is derived by the system, an operator can be alerted to the fault condition and can therefore try to identify the location of the leak in the hydraulic system and fix it.

The hydraulic diagnostic module 110 in some examples may be configured such that the predetermined threshold torque value selected for step 212 can vary depending on certain factors. For example, the predetermined leak torque value selected for the comparison carried out by the hydraulic diagnostic module 110 may differ depending on the characteristics of the particular pump of the hydraulic system.

Furthermore, the predetermined threshold torque value used in the comparison carried out by the hydraulic diagnostic module 110 may vary depending on the sensed hydraulic fluid temperature. The hydraulic diagnostic module 110 can receive as an input a first sensed temperature value corresponding to the temperature of the hydraulic fluid as sensed by a temperature sensor 22, so that the hydraulic fluid temperature can be taken into account when assessing the motor torque value required to reach the electric motor's first preset idling speed. The viscosity of the hydraulic fluid will vary depending on the temperature of the hydraulic fluid. Therefore, by means of the system using a predetermined threshold torque value which corresponds to the hydraulic fluid temperature, the accuracy of the system in identifying faults can be greater than otherwise. The temperature sensor 22 in some examples may be located at the hydraulic tank (as shown in FIG. 2) or in the suction hose leading to the hydraulic pump, as this can improve the accuracy of the diagnostics. This is because the viscosity of the hydraulic fluid can directly affect pump performance and consequently impact other motor performance characteristics. Temperature sensor 22 may be a sensor that is already installed as part of the hydraulic system. Alternately, if the hydraulic system does not have a temperature sensor, a temperature sensor 22 can be installed.

During diagnostic development of the hydraulic diagnostic module 110, data gathering is carried out on sample electrohydraulic systems, including recording of electric motor torque and hydraulic fluid temperature in order to establish a correlation between the torque and hydraulic fluid temperature for the particular system. This correlation is used when setting the predetermined torque values for step 212 and other steps of the diagnostic process 200.

Another diagnostic process that the hydraulic diagnostic module 110 can perform if the electric motor reaches its first preset idling speed is at step 214 of FIG. 3. At step 214 the hydraulic diagnostic module 110 receives the electric motor torque required for the electric motor to reach its first preset idling speed as an input and compares it with an expected torque value, namely a predetermined jam torque value. If the torque required to reach the electric motor's first preset idling speed is above said predetermined jam torque value, then the module derives a fault condition 208 as its performance status of the hydraulic system. The torque required to reach the motor's first preset idling speed being above a predetermined jam torque value is indicative of there being a jam in the hydraulic system, such as a jam in the hydraulic pump. A hydraulic jam fault condition may also be indicative of there being too much friction in the hydraulic system or insufficient lubrication in the hydraulic system. Once a fault condition is derived by the system, the hydraulic diagnostic module 110 can output an alert signal and an operator can fix the fault.

As with step 212, the hydraulic diagnostic module 110 may be configured such that the predetermined threshold torque value selected for step 214 can vary depending on certain factors. For example, the predetermined jam torque value selected for the comparison carried out by the hydraulic diagnostic module 110 may differ depending on the characteristics of the particular pump of the hydraulic system. Furthermore, the predetermined jam torque value used in the comparison at step 214 will depend on the hydraulic fluid temperature, based on the sensed hydraulic fluid temperature sensed by temperature sensor 22. In this way the system can take account of the hydraulic fluid temperature to improve the accuracy of the detection of jams in the hydraulics.

Another diagnostic process that the hydraulic diagnostic module 110 can perform if the electric motor reaches its first preset idling speed is at steps 220 to 228 of FIG. 3. Starting with step 220, the hydraulic diagnostic module 110 records the electric motor torque and hydraulic fluid temperature. The electric motor torque to be recorded may be the torque required to reach the electric motor's preset idling speed. Alternatively, the electric motor torque to be recorded may be the torque of the electric motor whilst it is running at its preset idling speed. The hydraulic fluid temperature in some examples may be the sensed hydraulic fluid temperature sensed by temperature sensor 22. The hydraulic diagnostic module 110 in some examples may have a memory for recording these and any other inputs.

At step 222 the instant motor torque is compared by the hydraulic diagnostic module 110 with a stored degradation model comprising data indicative of expected motor behavior so as to derive any signs of premature service events. The degradation model may be stored by the memory of the hydraulic diagnostic module 110 or accessed from an external memory which is accessible by the hydraulic diagnostic module 110 wirelessly or by network connection. The degradation model in some examples may comprise predicted data corresponding to a plurality of service intervals for the hydraulic system, and the hydraulic diagnostic module 110 in some examples may be configured to receive, as an input status, data regarding the instant service interval of the hydraulic system so as to correlate with the relevant data in the degradation table. The degradation model will have been previously devised by observing the electric motor torque and hydraulic fluid temperature as electrohydraulic systems degrade through use in order to determine threshold torque values corresponding to points at which it is recommended to take certain servicing actions such as replacement of serviceable items including hydraulic fluid and the hydraulic filter. For example, a threshold torque value for replacing the hydraulic fluid and a threshold torque value for replacing the hydraulic filter can be identified for the degradation model. This is useful as over time, the hydraulic fluid can become contaminated by debris such as wear debris, which can cause damage to components of the hydraulic system such as the pump. Clogged filters can release contaminants into the hydraulic system. Therefore, identifying premature degradation is very useful so that serviceable items can be replaced before causing damage to other components of the hydraulic system.

At step 224, if comparison of the recorded electric motor torque at particular hydraulic fluid temperature with the degradation model by the hydraulic diagnostic module 110 identifies that there is any acceleration of degradation, then the hydraulic diagnostic module 110 derives a maintenance requirement status as its performance status. At step 226, the hydraulic diagnostic module 110 is configured to output an alert if a maintenance requirement status is derived, which in this embodiment comprises output of an alert via a display, for example a user display in the electric work machine. At step 226, in the present embodiment the alert comprises update of a service schedule which can be displayed on the user display. If comparison of the recorded electric motor torque at particular hydraulic fluid temperature with the degradation model by the hydraulic diagnostic module 110 identifies no acceleration of degradation, then the diagnostic process ends (step 228). An identification of acceleration of degradation of motor performance may be an identification that the motor performance is deteriorating more quickly than expected as per the degradation model.

Figure 4:
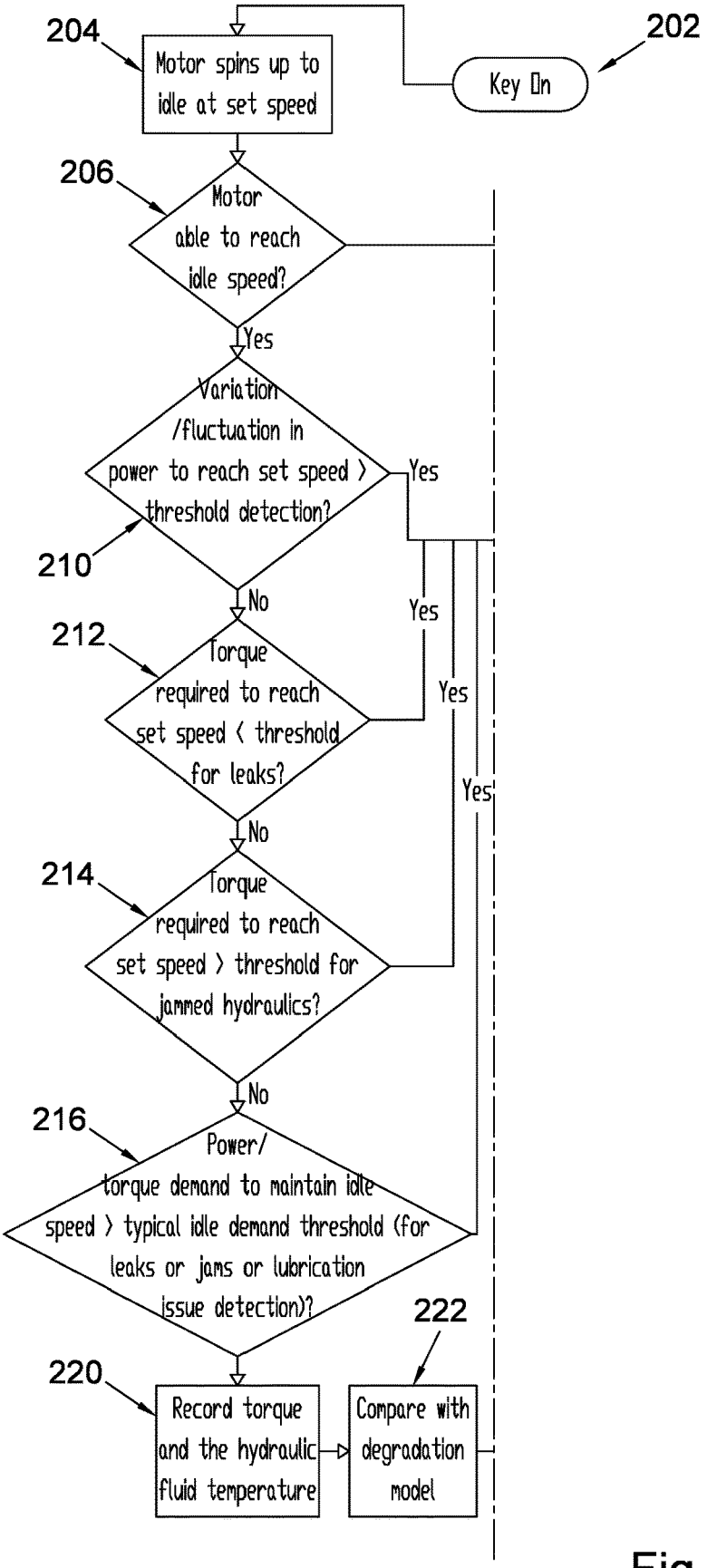
FIG. 4 is a flow chart of a further illustrative method performed by the hydraulic diagnostic module.
Figure 4:
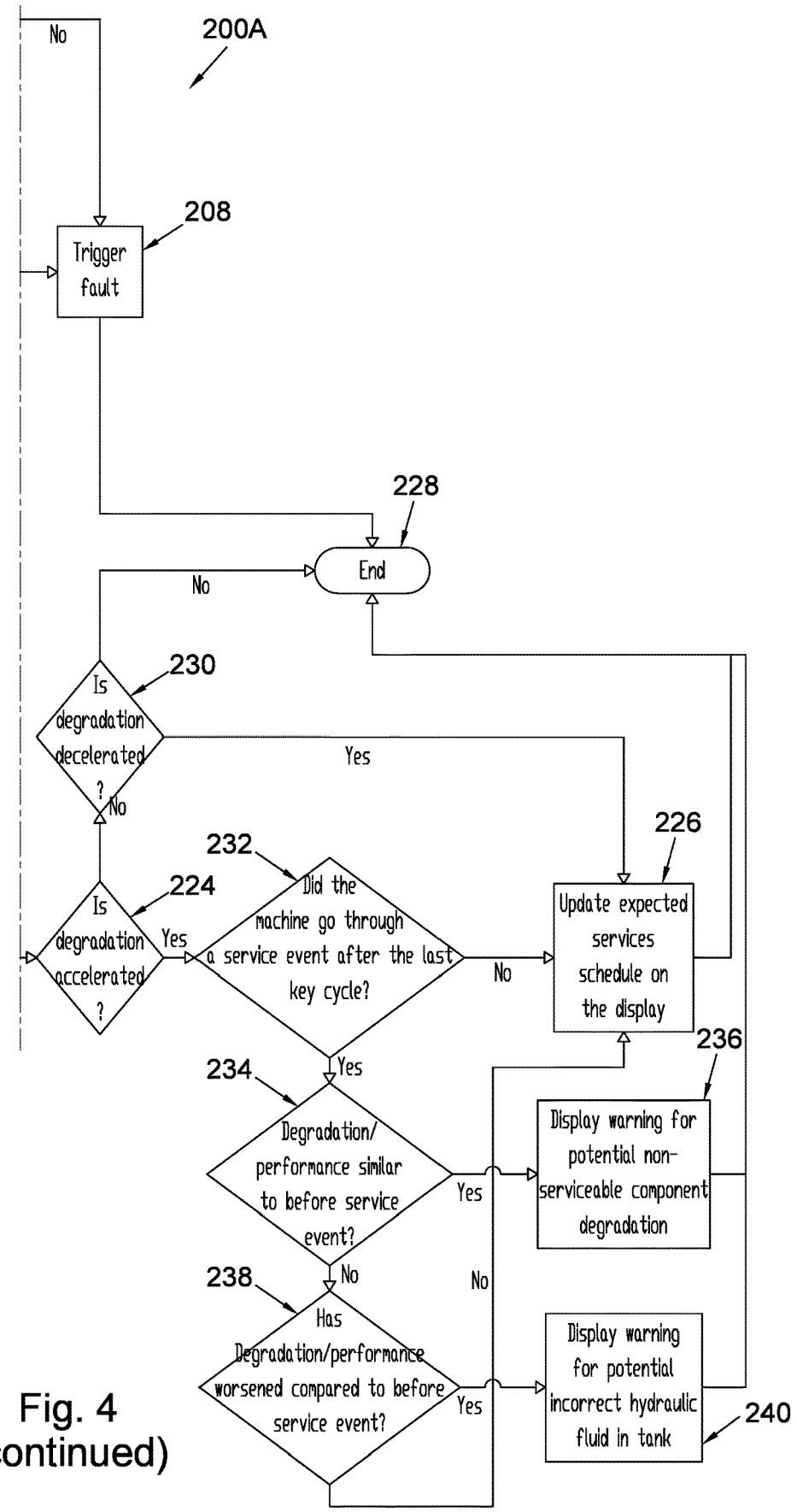

In an alternative diagnostic process 200A shown in FIG. 4, additional steps can be included in the diagnostic process. Diagnostic process 200A is like that of diagnostic process 200, except that certain additional steps are included. Steps 202 to 214 of process 200A are like that of process 200. A further diagnostic process that the diagnostic module 110 can perform if the electric motor reaches its first preset idling speed is at step 216 of FIG. 4. At step 216 the hydraulic diagnostic module 110 receives the power drawn by the pump or the torque demand to maintain the preset idling speed as an input and compares it with an expected value, namely a predetermined idling speed maintenance value. If the power or torque demand to maintain the preset idling speed is above said predetermined idling speed maintenance value, then the module derives a fault condition 208 as its performance status of the hydraulic system. The power or torque demand being above a predetermined idling speed maintenance value may be indicative of there being leak, jam or lubrication issue in the hydraulic system. If there is a leak in the system after the preset idling speed is reached, the output power or torque would remain higher than normal to maintain that specific idling speed. This is because a leak would cause pressure loss and the system would be unable to reach the required pressure value and the pump would require additional power to keep pushing fluid through the hydraulic system.

The diagnostic process 200A of FIG. 4 also includes further steps following the comparison of the electric motor parameters with the degradation model, in order to identify issues with non-serviceable components and/or identify whether incorrect hydraulic fluid has been introduced to the hydraulic system. Referring to FIG. 4, after step 224, if comparison of the recorded electric motor torque at particular hydraulic fluid temperature with the degradation model by the hydraulic diagnostic module 110 identifies no acceleration of degradation, at step 230 if comparison of the recorded electric motor torque at particular hydraulic fluid temperature with the degradation model identifies that degradation has decelerated, then the system is configured to update the expected service schedule (e.g. on the user display) (step 226). In this way, if deceleration of degradation compared to the degradation model is detected, the next service event can be delayed. This means that the system can avoid premature servicing taking place, for example if the equipment is only being lightly used, therefore saving on maintenance costs. At step 230 if comparison of the recorded electric motor torque at particular hydraulic fluid temperature with the degradation model identifies that degradation has not decelerated, then the diagnostic process ends (step 228).

At step 224, if comparison of the recorded electric motor torque at particular hydraulic fluid temperature with the degradation model by the hydraulic diagnostic module 110 identifies that there is acceleration of degradation, then instead of simply updating the expected service schedule as in diagnostic process 200, in diagnostic process 200A one or more further decision steps are included as shown in FIG. 4. If the determination at step 224 is affirmative, at step 232 there is a further decision step in which the diagnostic module 110 takes account of whether the hydraulic system underwent a service event since the last time the diagnostic process 200A was run (i.e. since the last key-on cycle). When a service event takes place, a scheduling module of the engine control unit (ECM) of the electric work machine is reset by a technician (for example, the scheduling module may count the number of days to the next recommended service event, and is reset to zero days when a service takes place). The hydraulic diagnostic module 110 can monitor the number of times the diagnostic process 200A is run since a service event and/or monitor the number of days since a service event as an input for step 232.

At step 232, if the determination of whether the hydraulic system underwent a service event since the last time the diagnostic process 200A was run is non-affirmative, at step 226 the expected service schedule is updated and the diagnostic process then ends (step 228). The service schedule update may be visible as an alert on the user display. In this way, the next scheduled service event can be brought forward, if acceleration of degradation is identified and no recent service event has taken place.

If the determination at step 232 is affirmative (i.e. acceleration of degradation has been detected and a service event took place since the last time the diagnostic process 200A was run), at step 234 the hydraulic diagnostic module 110 compares the current motor performance with that before the service event to determine whether the motor performance is similar to that before the service event (i.e. whether the level of degradation is similar to that before the service event). For example, the hydraulic diagnostic module 110 may assess the degradation and assign a measured degradation level, and if the measured degradation level is the same or below the degradation level measured before the last service event, the level of degradation would be determined as similar. The level of degradation could alternatively be determined as similar if it is within a predetermined range around the degradation level measured before the last service. If the motor performance is assessed as similar to that before the service event, at step 236, the hydraulic diagnostic module 110 derives a performance status, specifically a maintenance requirement status indicating that there is potential degradation of a non-serviceable component of the electrohydraulic system. Such a status may warn the operator of degradation of a non-serviceable item such as the electric motor, hydraulic pump, hydraulic valves, or hydraulic manifold. If similar degradation is detected shortly after a service event as compared to before the service event, even after replacement of serviceable items during the service event, then it is likely that the deterioration in performance is due to a problem with a non-serviceable item. At step 236, in the present embodiment the alert comprises a display warning of potential non-serviceable component degradation on the user display. The operator can therefore arrange an inspection of the non-serviceable components of the electrohydraulic system. The diagnostic process then ends (step 228).

If the determination at step 234 is non-affirmative (i.e. the motor performance is not determined to be similar to that before the service event), at step 238 the hydraulic diagnostic module 110 determines whether the motor performance has worsened compared to before the service event. For example, the hydraulic diagnostic module 110 may assess the degradation and assign a measured degradation level, and if the measured degradation level is greater than the degradation level measured before the last service event, the level of degradation would be determined as worsened. If the motor performance is assessed as worse compared to that before the service event, at step 240, the hydraulic diagnostic module 110 derives a condition of a warning of potential incorrect hydraulic fluid in the tank. Such a fault condition may also be attributed to other incorrect serviceable items having been introduced into the electrohydraulic system, such as an incorrect filter. If after a service event, the degradation assessed is similar to that before the service, the degradation can be fully attributed to the non-serviceable components. However, if the degradation is worsened, it can be attributed to incorrect hydraulic fluid or other incorrect serviceable items having been introduced during the service. When the fault condition at step 240 is derived by the system, the hydraulic diagnostic module 110 is configured to output an alert, which in this embodiment comprises a display warning of potential incorrect hydraulic fluid in the tank. The operator can therefore arrange testing and/or replacement of the hydraulic fluid. The diagnostic process then ends (step 228).

If the determination at step 238 is non-affirmative (i.e. the motor performance is not determined to be worse compared to that before the service event), at step 226 the expected service schedule is updated and the diagnostic process then ends (step 228). The service schedule update may be visible as an alert on the user display. In this way, the next scheduled service event can be brought forward, if acceleration of degradation is identified even though a service event has recently taken place.

At step 232, instead of determining whether the hydraulic system underwent a service event since the last time the diagnostic process 200A was run, the hydraulic diagnostic module 110 may determine whether the number of times the diagnostic process 200A was run since the last service event is below a threshold number, and if non-affirmative the process advances to step 226 and if affirmative, advances to step 234. Alternatively, at step 232, the hydraulic diagnostic module 110 may determine whether the time elapsed since the last service event is less than a threshold level, and if non-affirmative the process advances to step 226 and if affirmative, advances to step 234. In this way the system can seek to detect any degradation not attributable to serviceable items, i.e. if poor motor performance is still detected after a recent service event.

The data in the degradation model can be created and/or improved over time using data recorded from other electrohydraulic systems of the same kind. Said data may be gathered from a plurality of electrohydraulic systems telematically. A degradation model stored in the memory of a hydraulic diagnostic module 110 can be updated telematically with the data gathered from multiple other systems. The data gathered from a plurality of electrohydraulic systems can be used in machine learning systems in order to improve the diagnostic process 200. In this way, the accuracy of the degradation model can be improved as more data is collated.

The degradation model can also comprise data indicative of expected motor behavior over the lifetime of non-serviceable items associated with the system so that health of non-serviceable items such as the electric motor, hydraulic pump, hydraulic valves, and hydraulic manifold can be monitored. In this way, any acceleration in degradation of non-serviceable items can be identified so that the relevant non-serviceable item can be replaced before it becomes too degraded to operate. A degradation model incorporating data relevant to the health of non-serviceable components can be devised in a similar way to that for monitoring serviceable components, for example by observing the electric motor torque and hydraulic fluid temperature of a plurality of machines over their lifetime as the non-serviceable components degrade in order to determine threshold torque values corresponding to points at which it is recommended to take certain servicing actions such as replacement of a particular non-serviceable component.

Steps 220 onwards in some examples may only be carried out if no fault condition 208 is triggered by any of steps 206 to 216. The hydraulic diagnostic module 110 may be configured to carry out steps 220 onwards independently of any of steps 206 to 216.

As mentioned above, in the embodiment of FIG. 3 or 4 the diagnostic process 200, 200A is run by the hydraulic diagnostic module 110 every time the electric motor 20 is switched on (i.e. at 'key-on', step 202). In this way, monitoring of the health of the health of the hydraulic system can be carried out regularly. The diagnostic process 200 may be run at points other than key-on. For example, the hydraulic diagnostic module 110 may have a diagnostic mode which an operator can select (i.e. a user induced diagnostic process), which if selected runs the diagnostic process 200, 200A or parts of the diagnostic process 200, 200A. If diagnostic mode is selected by the operator, the hydraulic diagnostic module 110 receives a signal which causes the diagnostic process 200 to run. The operator would usually only select the diagnostic mode if the electric motor is idling. Furthermore, if the electrohydraulic system has an automatic idle control feature wherein the electric motor is switched to idle when the machine has been inactive for a predetermined amount of time, the hydraulic diagnostic module 110 may be configured to enter a diagnostic mode when the electric motor has been switched to idle by the automatic idle control, which causes the diagnostic process 200 or parts of the diagnostic process 200 to run. For example, the automatic idle control feature may be configured to detect if there has been no fluctuation in motor speed for more than a predetermined time, and if so, the automatic idle control feature causes the electric motor speed to reduce to its preset idling speed and the hydraulic diagnostic module 110 enters diagnostic mode which causes the diagnostic process 200 or parts of the diagnostic process 200 to run. When running the diagnostic process 200 at instances other than key-on, instead of monitoring the electric motor parameters as it spins up to its preset idling speed, the diagnostic system may monitor the electric motor parameters (such as electric motor torque, power drawn by the hydraulic pump, etc.) required to maintain the electric motor at its preset idling speed, but otherwise the diagnostic process will be alike that of FIG. 3.

Figure 5:
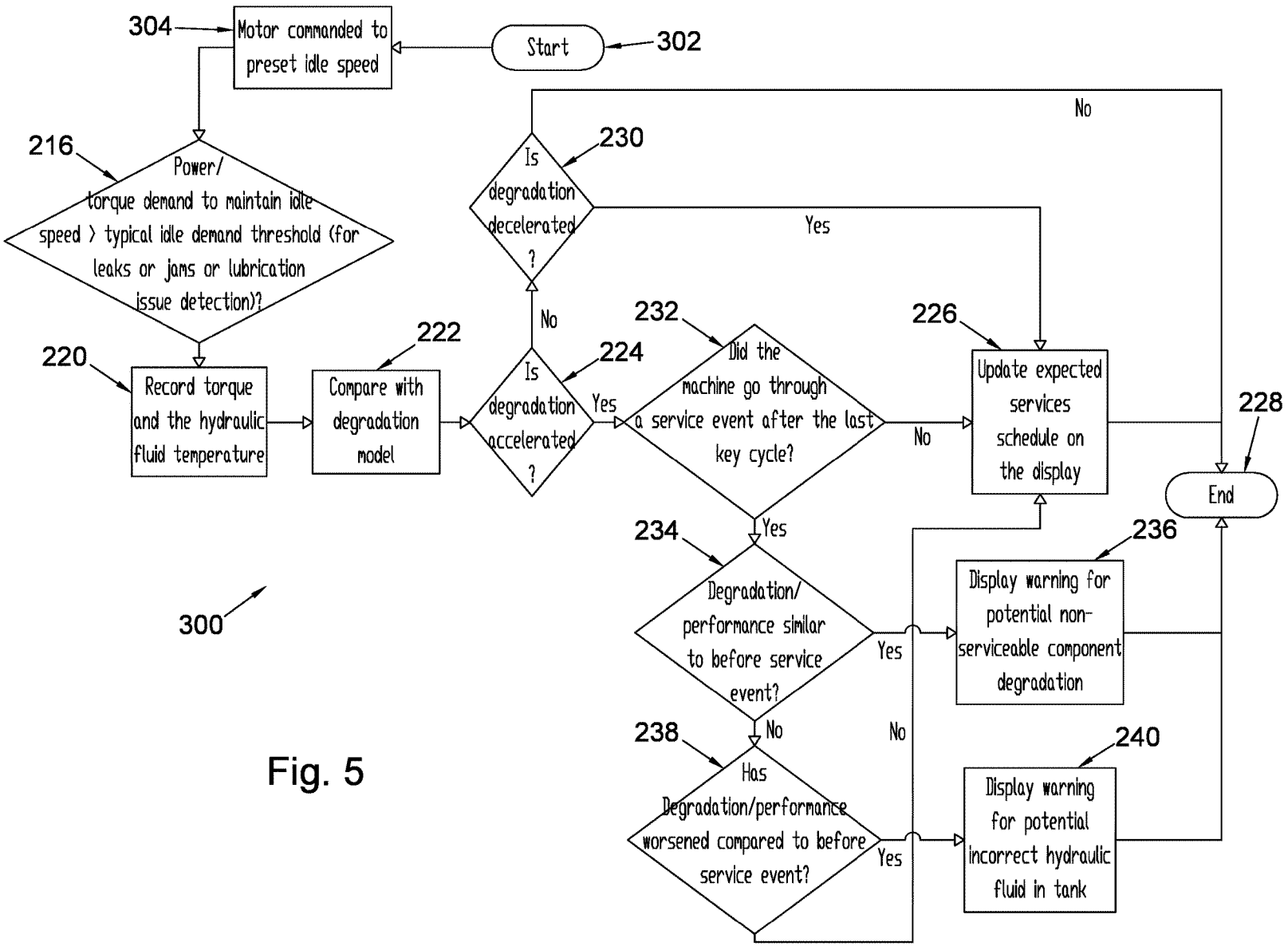
FIG. 5 is a flow chart of a further illustrative method performed by the hydraulic diagnostic module.

An example of a user induced diagnostic process 300 is shown in FIG. 5. The user induced diagnostic process 300 starts at step 302, when the user selects to run the diagnostic process. At step 304, the electric motor 20 is commanded by the system to run at the preset idling speed. The following steps then mirror steps 216 onwards of diagnostic process 200 of FIG. 4 (and like reference numerals are used in FIG. 5).

The diagnostic process 200, 200A, 300 can end (step 228) after any point in the diagnostic process and it is not necessary for the diagnostic process to include all of the decision points of any of the particular processes 200, 200A, 300 (e.g. step 206, 210, 212, 214, 216, 224, etc.), and it may include one or only some of those decision points.

Steps 210, 212, 214, and/or 220 of the diagnostic process 200, 200A can be run simultaneously by the hydraulic diagnostic module 110. Steps 210, 212, 214 and 220 can be run sequentially in any order. Any of steps 206 to 226 of diagnostic process 200 or steps 206 to 240 of diagnostic process 200A, 300 can be left out of the diagnostic process.

An algorithm circuit for carrying out the diagnostic process 200, 200A, 300 may be provided. The algorithm circuit may be embodied as machine or computer-readable media that is executable by a processor of the hydraulic diagnostic module 110. The computer readable program code may be executed on one processor or multiple processors. In the latter scenario, the remote processors may be connected to each other through any type of network. In another configuration, the algorithm circuit is embodied as a hardware unit of the hydraulic diagnostic module 110. The algorithm circuit may take the form of one or more circuits.

The present diagnostic system and method for determining a performance status of a hydraulic system can be used to detect faults such as air, leaks, jams or blocks in the hydraulic system without any additional sensors (i.e. with use of only the hydraulic fluid temperature sensor for some optional parts of the diagnostic process, which is already present in a standard hydraulic system). If the hydraulic system does not have its own hydraulic fluid temperature sensor, a hydraulic fluid temperature sensor can be added to the hydraulic system and configured such that signals relating to hydraulic fluid temperature can be received by the hydraulic diagnostic module 110 as an input. The diagnostic system and method also allows the prediction of service/maintenance events on the hydraulic system (for example hydraulic fluid change, filter change, etc.). The present invention provides a way to identify faults such as leaks or blocks in the hydraulic system early on. It also allows for serviceable components of the hydraulic system to only be changed when needed, meaning that the hydraulic fluid or filter are not changed too early, avoiding unnecessary expense. It also avoids such serviceable components being replaced too late, which may damage other components of the hydraulic system. The invention is able to detect drift in the current required by the electric motor over time to help identify wear and potential failures. And the invention can diagnose potential wrong hydraulic fluid type used during servicing of the hydraulic system.

It will be appreciated that embodiments of the present disclosure have been described above by way of example only, and modifications in detail will be apparent to the skilled person within the scope of the appended claims. Embodiments of the disclosure have been described above by way of example only. Features of one embodiment may be used with any other embodiment. Other modifications will be apparent to the skilled person within the scope of the claims.

In particular and in regard to the various functions performed by the above described components, devices, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

What is claimed is:

1. A diagnostic system for determining a performance status of a hydraulic system of an electric work machine, the hydraulic system having a hydraulic pump driven by an electric motor for pumping hydraulic fluid within the hydraulic system, the diagnostic system comprising:

a hydraulic diagnostic module configured to receive an operating variable including a motor speed of the electric motor detected based on a feedback from the electric motor, the feedback including one or more voltage measurements and current measurements associated with the electric motor, compare the motor speed with the electric motor spinning up from a non-rotating condition to reach an idling speed of the electric motor within a predetermined time, and in response to the comparison, defect a fault condition as the performance status of the hydraulic system based on the electric motor failing to reach the idling speed within the predetermined time.

2. The diagnostic system of claim 1, wherein the hydraulic diagnostic module is further configured to receive a signal corresponding to a sensed temperature value sensed by a temperature sensor configured to sense a temperature of the hydraulic fluid, the hydraulic diagnostic module being configured to compare the operating variable of the electric motor with a predetermined operational behavior that is variable depending on said sensed temperature value.

3. The diagnostic system of claim 1, wherein the operating variable of the electric motor further comprises motor torque, or power drawn by the hydraulic pump.

4. The diagnostic system of claim 1, wherein the performance status of the hydraulic system further comprises a maintenance requirement.

5. The diagnostic system of claim 4, wherein the maintenance requirement comprises one or more of the following:

an indication that the hydraulic system requires a fluid change; or an indication that the hydraulic system requires a filter change.

6. The diagnostic system of claim 4, wherein the maintenance requirement comprises a predicted maintenance requirement derived from the comparison of the operating variable of the electric motor with a predetermined operational behavior.

7. The diagnostic system of claim 1, wherein the fault condition comprises one or more of the following:

a hydraulic pump jam;

a blockage in the hydraulic system;

a trapped air condition indicating air entrapped within at least part of the hydraulic system;

a leak condition indicating leakage within at least part of the hydraulic system;

a misalignment condition indicating misalignment of any parts within the hydraulic system; and incorrect hydraulic fluid present in the hydraulic system.

8. The diagnostic system of claim 1, wherein the operating variable further comprising power drawn by the hydraulic pump during the spinning up of the electric motor to reach the idling speed, and the operating variable is compared with a predetermined power drawing activity of the hydraulic pump during the spinning up of the electric motor to reach the idling speed, wherein the hydraulic diagnostic module derives the fault condition as the performance status of the hydraulic system in response to the power drawn by the hydraulic pump deviating from the predetermined power drawing activity.

9. The diagnostic system of claim 8, wherein the hydraulic diagnostic module is configured to derive the fault condition as the performance status of the hydraulic system in response to the power drawn by the hydraulic pump during the spinning up of the electric motor to reach the idling speed being outside of a predetermined range.

10. The diagnostic system of claim 1, wherein the operating variable comprising motor torque required during the spinning up of the electric motor to reach the idling speed, the hydraulic diagnostic module further configured to compare the operating variable with the electric motor spinning up to reach the idling speed at a predetermined threshold motor torque, wherein the hydraulic diagnostic module derives a leak condition indicating leakage within at least part of the hydraulic system as the performance status of the hydraulic system in response to the motor torque required during the spinning up being less than the predetermined threshold motor torque.

11. The diagnostic system of claim 1, wherein the operating variable comprising motor torque required during the spinning up of the electric motor to reach the idling speed, the hydraulic diagnostic module further configured to compare the operating variable with the electric motor spinning up to reach the idling speed at a predetermined threshold motor torque, wherein the hydraulic diagnostic module derives a hydraulic pump jam as the performance status of the hydraulic system in response to the motor torque being more than the predetermined threshold motor torque.

12. The diagnostic system of claim 1, wherein the operating variable comprises motor torque of the electric motor, and the hydraulic diagnostic module is further configured to record the motor torque and a sensed temperature value of the hydraulic fluid such that the motor torque and the sensed temperature value at a plurality of instances over time can be recorded as recorded system data, the hydraulic diagnostic module being configured to derive a maintenance requirement status in response to a change in motor performance or an acceleration in the change in motor performance based on comparing the motor torque with the recorded system data.

13. The diagnostic system of claim 1, wherein the operating variable comprises motor torque of the electric motor and the hydraulic diagnostic module is further configured to record the motor torque and a sensed temperature value of the hydraulic fluid at a plurality of instances over time as recorded system data, the hydraulic diagnostic module being configured to derive a maintenance requirement status based on comparing the recorded system data with a degradation model indicative of expected motor behavior.

14. The diagnostic system of claim 1, further comprising an output device for alerting an operator to a derived performance status.

15. The diagnostic system of claim 1, wherein the hydraulic system has a key-on mode in which the electric motor is spinning up to reach the idling speed, the diagnostic system being configured to determine the performance status of the hydraulic system during the key-on mode.

16. The diagnostic system of claim 1, wherein the hydraulic system has a diagnostic mode in which the diagnostic system is configured to determine the performance status of the hydraulic system in response to the diagnostic system being converted to the diagnostic mode.

17. An electric work machine having at least one work device that is hydraulically powered by a hydraulic system having a hydraulic pump driven by an electric motor for pumping hydraulic fluid within the hydraulic system, the electric work machine comprising a diagnostic system for determining a performance status of the hydraulic system, the diagnostic system comprising:

a hydraulic diagnostic module configured to receive an operating variable of the electric motor including a motor speed of the electric motor detected based on a feedback from the electric motor, the feedback including one or more voltage measurements and current measurements associated with the electric motor, the hydraulic diagnostic module further being configured to compare the motor speed with the electric motor spinning up from a non-rotating condition to reach an idling speed of the electric motor within a predetermined time, and, in response to the comparison, detect a fault condition as the performance status of the hydraulic system based on the electric motor failing to reach the idling speed within the predetermined time.

18. A method for determining a performance status of a hydraulic system of an electric work machine, the hydraulic system having a hydraulic pump, driven by an electric motor, for pumping hydraulic fluid within the hydraulic system, the method comprising, (a) detecting a feedback from the electric motor, the feedback including one or more voltage measurements and current measurements associated with the electric motor;

b) comparing an operating variable comprising a motor speed of the electric motor with the electric motor spinning up from a non-rotating condition to reach an idling speed of the electric motor within a predetermined time; and c) in response to the comparison, detecting a fault condition as the performance status of the hydraulic system based on the electric motor failing to reach the idling speed within the predetermined time.

* * * * *